US006292742B1

(12) United States Patent
Heimann et al.

(10) Patent No.: US 6,292,742 B1
(45) Date of Patent: Sep. 18, 2001

(54) TRANSMISSION OF LOCALIZED TRAFFIC INFORMATION

(75) Inventors: Josef Heimann, Düsseldorf; Werner Schulz, Meerbusch; Stefan Vieweg, Willich, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/367,142

(22) PCT Filed: Feb. 2, 1998

(86) PCT No.: PCT/DE98/00385

§ 371 Date: Aug. 6, 1999

§ 102(e) Date: Aug. 6, 1999

(87) PCT Pub. No.: WO98/35331

PCT Pub. Date: Aug. 13, 1998

(30) Foreign Application Priority Data

Feb. 6, 1997 (DE) ..... 197 06 037
Nov. 19, 1997 (DE) ..... 197 53 050

(51) Int. Cl.[7] ..... G03G 1/09
(52) U.S. Cl. ..... 701/117; 701/119

(58) Field of Search ..... 701/117, 118, 701/119, 209, 211; 340/995

(56) References Cited

U.S. PATENT DOCUMENTS 5,164,904 * 11/1992 Sumner ..... 701/117
5,801,943 * 9/1998 Nasburg ..... 701/117
5,831,552 * 11/1998 Sogawa et al. ..... 340/995
5,908,464 * 6/1999 Kishigami et al. ..... 701/208

* cited by examiner

*Primary Examiner*—Michael J. Zanelli
(74) *Attorney, Agent, or Firm*—Cohen, Pontani, Lieberman & Pavane

(57) ABSTRACT

Condensing of information is achieved by a terminal device, a traffic center and a method for informing a user of a terminal device about the traffic situation in a traffic network using traffic information transmitted from a traffic center to the terminal device over a communications channel. Traffic information relating to at least one section in the traffic network is converted to information relating to zone in the traffic network, and zone-oriented traffic information is displayed to the user of the terminal device.

15 Claims, 4 Drawing Sheets

TRANSMISSION OF LOCALIZED TRAFFIC INFORMATION

BACKGROUND OF THE INVENTION

1. Field of the Invention

The invention related to transmission of traffic information, and more particularly to a method and device for informing a user about the traffic situation in a traffic network.

2. Description of the Related Art

Information that is relevant for traffic is referred to hereinafter as "traffic information". Strictly speaking, this traffic information includes known bulletins concerning traffic backups, accidents, obstructions, etc. as well as measurements data such as speed or the quantity of vehicles which pass a measured cross section. But, in a broader sense, it also includes information about the surrounding environment such as weather information (freezing rain, fog) and restrictions (speed limits, non-resident limited access, prohibition against trucks, watershed areas, etc.). Information about tolls due or toll amounts also makes up a part of the traffic information in this context. Traffic information conventionally concerns route sections of a road network in particular. Also, general information (such as about fog) ultimately always relates to individual sections of road. Therefore, systems that are known and in use today reference the information to sections of road. A familiar example is verbal radio broadcast bulletins (e.g., "5-km backup on A3 between . . . and . . . "). There are also known systems which transmit these reports in code. In this case, for example in RDS/TMC, reference is made to a coded section of road.

First steps towards a quantitative integration of zone-related traffic information in traffic situation models have been proposed by the present Applicant, for example, in Patent Applications DE-P 195 26 148.8 and DE-P 196 50 844.4. The transmission of quantitative data measured in a point-by-point manner, in particular average speeds, is also known (WO 90/05959, Martell, et al.).

All of these methods have in common that the transmission of increasingly detailed information faces limitations in technical and ergonomic respects. On the technical side, the chief limiting factors are the available transmission bandwidth and communication costs; and on the ergonomic side, a large amount of extensively redundant information is transmitted or displayed because a characteristic (e.g., fog) can extend over many sections of road.

A further grave disadvantage of route section-oriented information consists in that both the traffic center and the receiver must have a common reference, i.e., a road section network known to both. If the center references the information as "4711", which defines a certain section of road, this reference must be known to the reception device for further processing, that is, the reception device must have or use the same "road map".

It is also practicable to reference a very limited partial network, especially a highway network (compare RDS/TMC). However, if this procedure is extended to the entire road network, the method, if it can be realized at all in technical respects, is very uneconomical. In particular, the problems of the common reference system also quickly become extremely complex when the entire road network must be maintained and updated in both the center and terminal device.

SUMMARY OF THE INVENTION

It is the object of the present invention to reduce traffic information while preventing loss of quality as far as possible. The amount of information to be transmitted is reduced by means of a reduction of information on the traffic center side through the conversion of route section-oriented traffic information into zone-oriented traffic information. On the terminal device side, this reduction of information is carried out by optimizing the information for further processing and/or simplified or concise display.

The present invention avoids the disadvantages of the prior art. The system is formed of a traffic center (or a plurality of centers) which gathers and makes available the traffic information and at least one receiver of this traffic information. Traffic information is transmitted from the center to the receiver via a communications channel. The basic idea of the invention consists in converting the information which is generally collected as road section-oriented data into zone-oriented information by means of a processing unit and accordingly making the traffic information available in the form of zone-oriented information.

The processing unit can advantageously be put to use on the traffic center side as well as on the reception side. In the first instance, a radical reduction in transmitted information is achieved, i.e., with a primarily technical-commercial advantage. In the second instance, a radical reduction of redundant information is achieved, which is advantageous chiefly in ergonomic respects, especially with respect to the display. This different sequence is shown in the accompanying drawings.

In the process according to the invention, the information is preferably in quantitative form, that is, with a quantization greater than binary, e.g., quaternary. However, the method can also be utilized advantageously when certain characteristics such as "fog", "watershed area", or the like are quantized through simple binary affiliation (yes/no). Other features such as tolls due along a section of road located ahead of the vehicle terminal device in the driving direction can be quantized in differentiated quantitative indication (e.g., charge per km) but also in the form of the above-mentioned yes/no allocation.

BRIEF DESCRIPTION OF THE DRAWINGS

Features and advantages of the invention are indicated in the following description of an embodiment example with reference to the drawings, wherein.

DETAILED DESCRIPTION OF THE PREFERRED EMBODIMENTS

Figure 1:
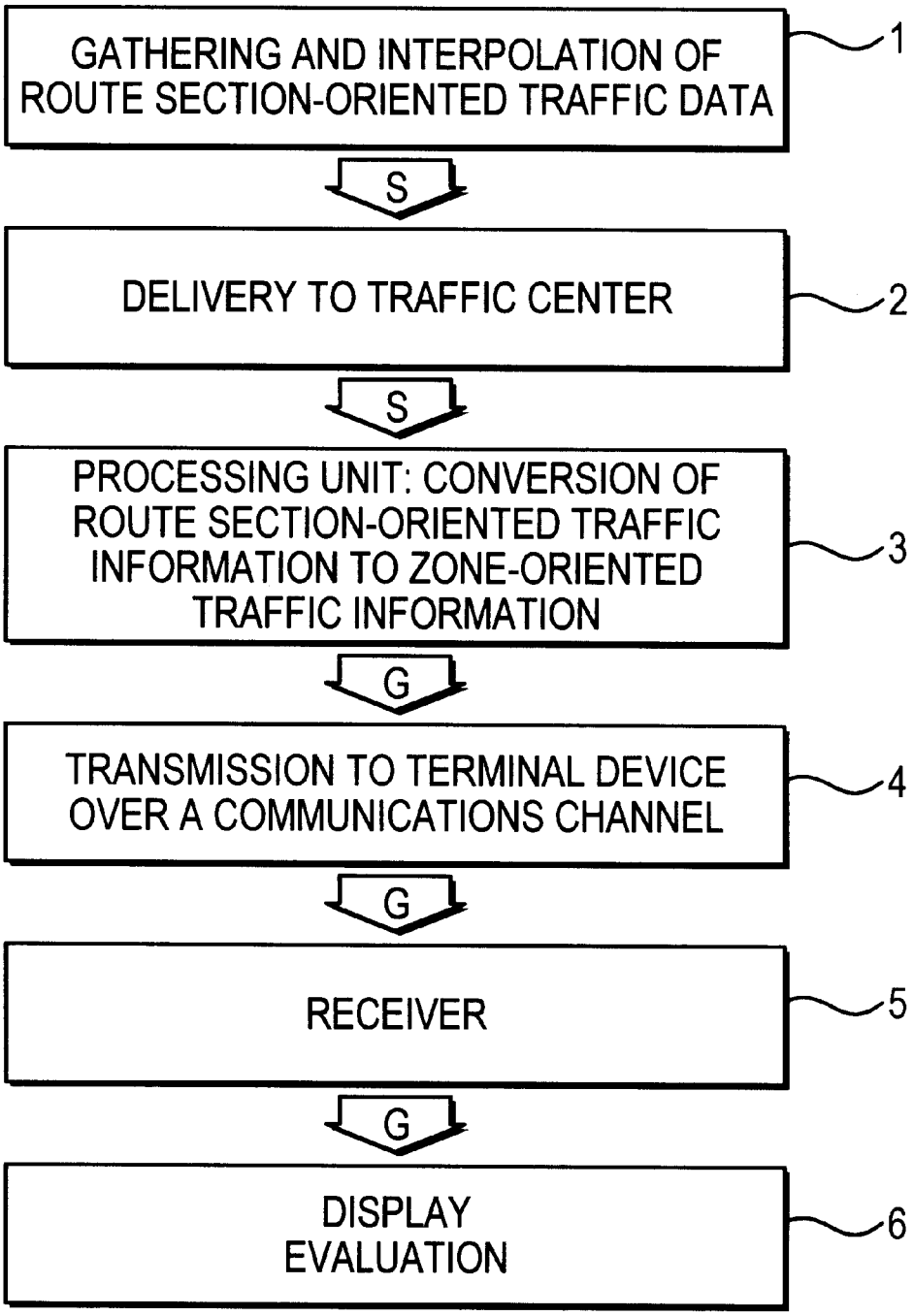
FIG. 1 is a data flowchart of traffic information according to an embodiment of the invention.

The importance of the method according to the invention is shown by way of the following example. Currently, there are a wide variety of devices on the market which are carried along in the automobile and which provide the driver with assistance or instructions for navigation by means of position-fixing—usually via satellite—based on a map which is also carried along in the automobile. A traffic disturbance can be received, for example, in the form of a verbal traffic delay bulletin (e.g., "3-km backup on A3 between . . . and . . . "). Ideally, this report should be taken into account in the ongoing navigation or route planning. The question immediately presenting itself with respect to the integration of such singular or individual reports is that of the advisability of a possible detour based on the traffic situation. However, due to the fact that only singular reports are transmitted, the driver is basically ignorant of the road sections that are not referenced. For this reason, details must be substantially increased, particularly with respect to alternate or secondary roads. Therefore, when traffic information is to serve as a basis for deciding on alternatives (alternative routes, alternative means of transportation or the like), information about these alternatives must also be supplied (this was illustrated herein in relation to the technical example of navigation, but also applied in general). However, further detailing also has its limits. For example, when traffic information about inner cities is also required, preparation of information oriented to road sections is not practical. A very large amount of roads would have to be named for this purpose, all of which contain the same information (e.g., "congested"). From the user's perspective, the problem in the selected example can be described in a simple manner: "The whole inner city is congested." In this case, a sweeping of general statement is made. The essence of the invention consists in converting this qualitative process into an efficient method which can be technically and commercially implemented.

For this purpose, in a first step, quantitative traffic data are gathered is stored. This is advisable because an average must be taken in some way or other in later steps. In a preferred embodiments, this average relates, for example, to average driving speeds on the individual road sections. Other measurable quantities such as travel times, number of vehicles, or the like are also possible. In practice, it is unlikely that there will be data on all sections of road. Therefore, it is generally necessary to supplement the measurement data with plausible assumptions. These assumptions can simply be derived from structural features (type of road, speed limit, or the like) or from more complex empirical databases (time-variation curves). Possible procedures for this purpose are described in the subclaims.

In the second step, the information is generalized; by averaging a plurality of road sections within a zone. The many individual pieces of information on many road sections are converted into averaged information on all road sections of this zone. Accordingly, in the specified example, an average speed is determined.

For practical use, it may be advantageous to distinguish between different categories of road, i.e., to determine individual average values for highways, inner city roads, etc, because the indication "60 km/h", for example, has different meanings on different types of road. In addition, or alternatively, it is proposed that the type of road be taken into account through the maximum possible or maximum permitted speed, and accordingly a relative value (e.g., 80% of the maximum speed) is to be determined. Indication of an obstruction (e.g., 20%) is equivalent to this. This procedure has decisive advantages particularly with respect to the transmission of information concerning obstruction caused by weather, since a statistic or measure for the degree of obstruction can be indicated in an all-inclusive manner for all types of road (e.g., fresh snowfall, fog or the like).

The averaging process itself can be applied to a given zone (e.g., city limits). Another advantageous embodiment of the invention consists in determining zones having identical values, i.e., defining the zone based on the available data. An additional averaging process must also take place in this case for reducing information because precise equivalence cannot be used as a criterion in this case but, rather, a speed range (e.g., between 50 and 60 km/h) must be averaged in practice. Accordingly, a particularly preferred embodiment consists in making information available in the form of contour surfaces, which are referred to as isotachs in special cases involving speed.

Redundant information is eliminated to a great extent by means of this procedure, so that the information is condensed. On the one hand, this can be used advantageously for condensing on the part of the traffic center. The condensed (zone-oriented) information can accordingly be economically transmitted over the communications channel. On the other hand, the process can also be advantageously applied on the reception side for displaying and/or for further processing. This is useful particularly when, in spite of the availability of efficient transmission channels (e.g., DAB =digital audio broadcast), the information should be presented concisely or should be further processed in a zone-oriented manner. This advantage is especially obvious with respect to (automatic) integration or feed of information in an autonomous navigation device. The information (for the zone) is made available in its entirety, although in averaged form, without overburdening the transmission channel and without being impeded as a result of problems with referencing to possibly incompatible road section systems (i.e., the road sections on a digital map) and can be converted for further processing in internal reference systems (i.e., a map onboard the vehicle).

The process has been described with reference to traffic information representing speeds, but it also transferrable to other quantities relevant for traffic. For example, it is possible to apply the process to traffic backup probabilities or the like statistics for obstructions or use restrictions. Indication of basic restrictions such as areas exclusively for resident traffic, quiet zones, zones not open to heavy trucks, watershed areas, etc. can be realized by means of this method. A further possible application is the display of fee functions such as tolls, etc.

Figure 2:
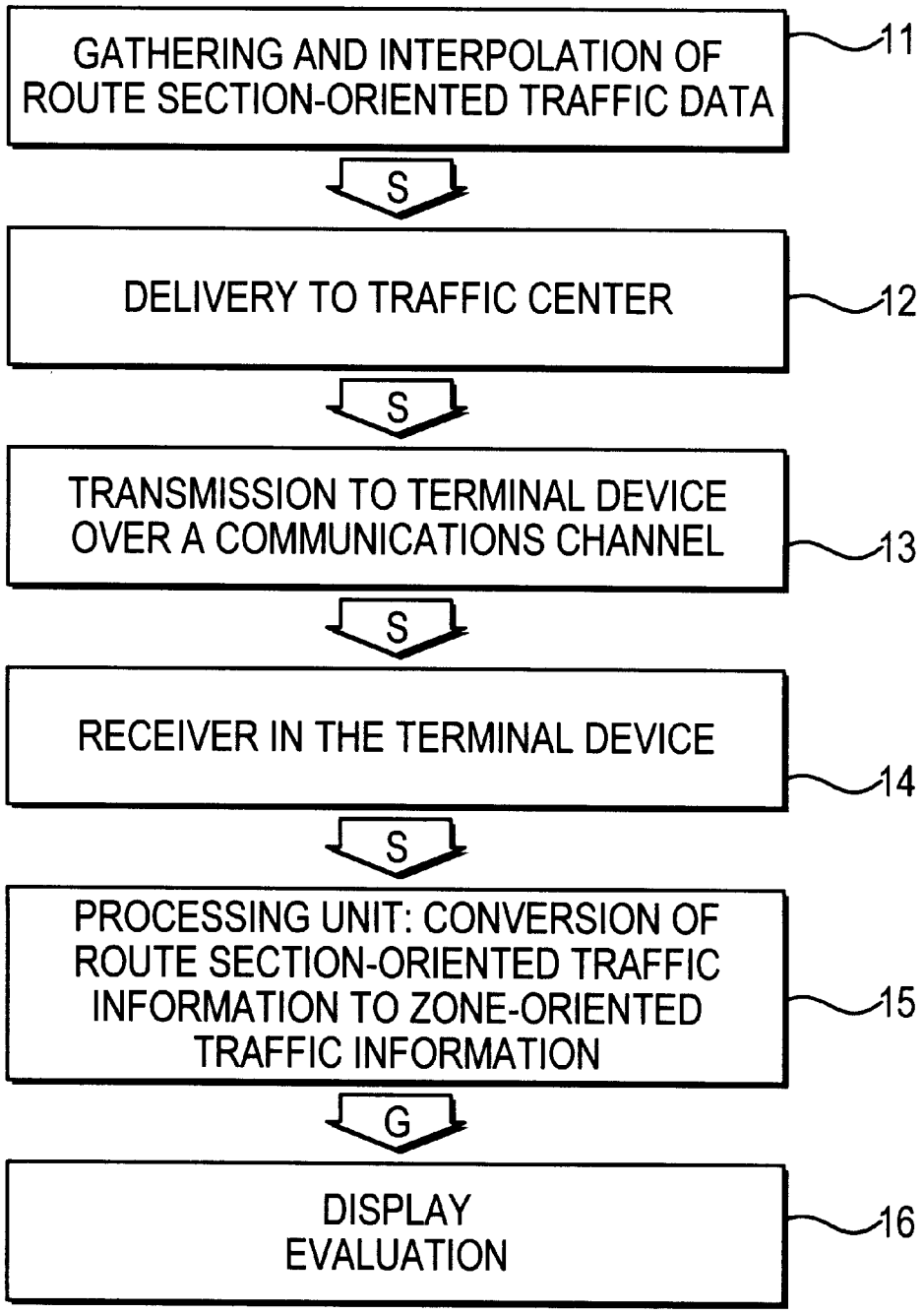
FIG. 2 is a flow diagram of the data flowchart of traffic information for another embodiment example.

FIG. 1 shows a schematic data flowchart for the embodiment example with conversion of the route section-oriented data into zone-oriented data in the traffic center, while FIG. 2 shows a schematic data flowchart for the embodiment example of conversion of route section-oriented traffic information into zone-oriented traffic information in the terminal device.

In FIG. 1, route section-oriented traffic data are gathered and, where appropriate, interpolated in step 1 through measurement, historical databases, etc. The route section-oriented data are made available to the traffic center in step 2 for possible further processing, e.g., traffic forecasts, etc. The route section-oriented traffic information (designated by S) is then converted in step 3 into zone-oriented traffic information (designated by G) in a processing unit. Subsequently, in step 4, the zone-oriented traffic information (G) is transmitted via a communications channel, especially a radio channel, e.g., a mobile radio channel, especially a short-message channel (GSM-SMS), from the traffic center to a receiver (Step 5) in a terminal device in a vehicle. In the receiver, the transmitted zone-oriented (G) traffic information is optically and/or acoustically displayed (Step 6) to the user of the terminal device and/or evaluated and taken into account, e.g., for navigation recommendations. The above-mentioned transformation of route section-oriented traffic information into zone-oriented traffic information in a processing unit in the traffic center has the advantage that the amount of information to be transmitted over the communications channel is reduced.

FIG. 2 shows an exemplary embodiment of the conversion of the route section-oriented (S) traffic information into zone-oriented (G) traffic information in a terminal device in a vehicle. In step 11, route section-oriented traffic data are collected and, as the case may be, supplemented by interpolation, etc. Insofar as the collecting and interpolating do not already take place in the traffic center, the route section-oriented traffic information is transmitted to the traffic center in step 12. In step 13, route section-oriented information is transmitted from the traffic center over a communications channel to a receiver in a terminal device in a vehicle. In step 14, the transmitted traffic data is stored in the receiver. Route section-oriented traffic information (S) is transmitted from the receiver to a processing unit which is likewise on the terminal device side. In step 15, the route section-oriented traffic information is converted into zone-oriented traffic information (G) by the processing unit and is transmitted to a display and/or evaluating unit in the terminal device. The zone-oriented information can then be displayed to the user of the terminal device in zone-oriented form (step 16). Zone-oriented information can also be further evaluated and used, for example, to generate navigation recommendations or the like.

Figure 3:
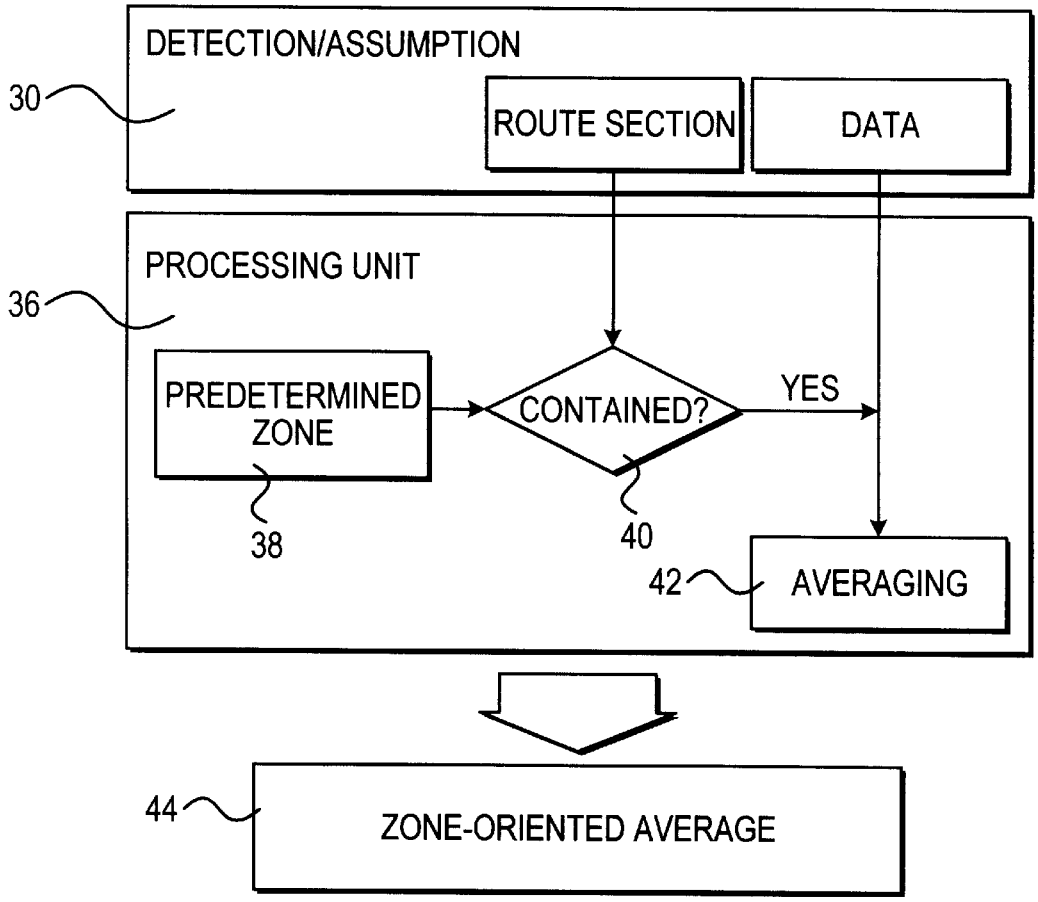
FIG. 3 is a flow diagram of a conversion of route section-oriented traffic information into zone-oriented traffic information.

FIG. 3 shows the allocation of route section-oriented traffic information in zone-oriented traffic information in the traffic center or in the terminal device. Route section-oriented information is detected 30 and/or supplemented through historic databases and/or assumptions concerning the spatial and/or temporal configuration. Route section-oriented traffic information (referred to as "data" in FIG. 3) exists for individual sections in the traffic network. This route section-oriented traffic information is allocated to individual zones in the processing unit 36 in the terminal device or in the traffic center. In so doing, a zone is defined arbitrarily or in accordance with predetermined parameters. For every predetermined 38 zone, a check is carried out as to whether the route section or route sections to which the route section-oriented traffic information refers is or are contained 40 in the predetermined zone. If it is contained, it is included in the averaging of traffic information 42 in the given zone. For example, the average values of all known speeds in a determined spatial zone can be taken into account. The average of traffic information determined for this zone, (for example, average value of speeds in the zone) is the zone-oriented average 44 that is, the zone-oriented traffic information for this zone.

Figure 4:
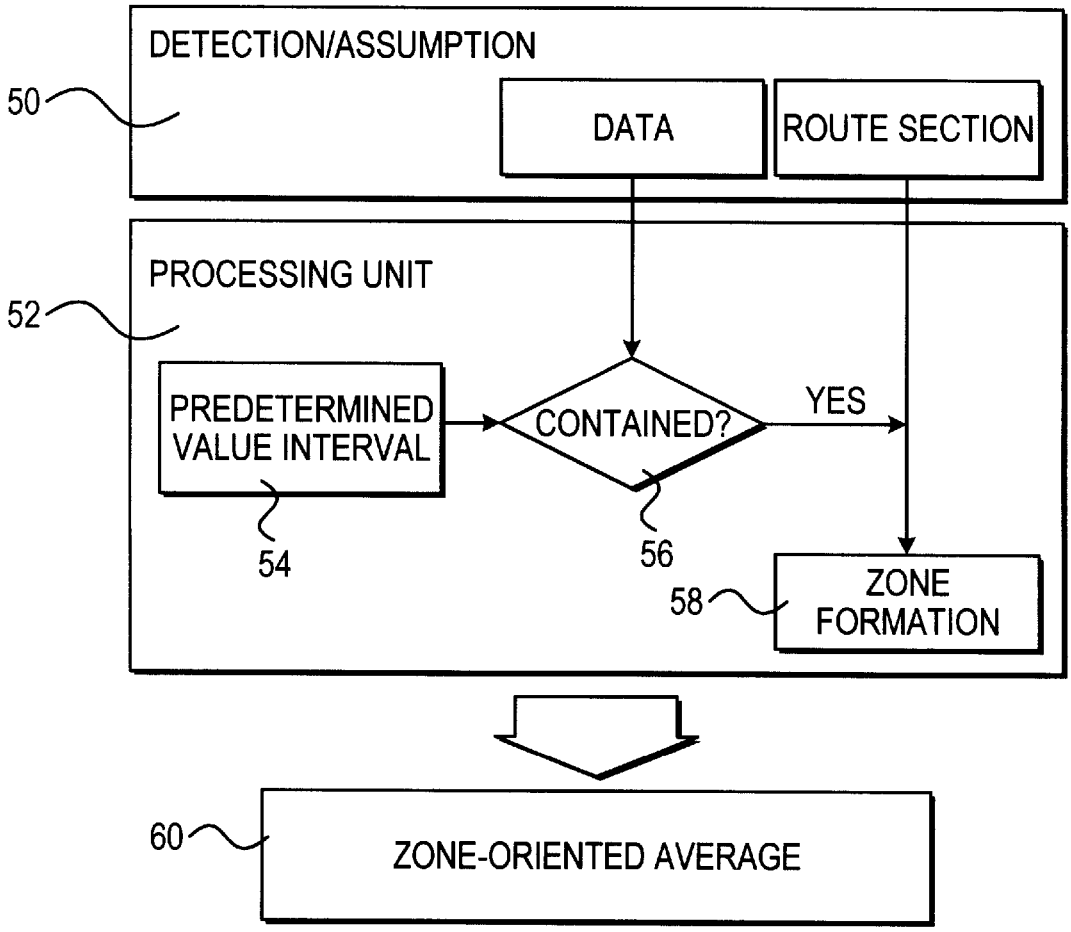
FIG. 4 shows the definition of a zone according to the invention.

FIG. 4 shows an example for the definition of a zone (as is used, for example in FIG. 3). Based on traffic information ("data") detected 60 on at least one route section of a traffic network, a zone is defined over the amount of traffic information, especially speeds. In this case, a value interval is given for the traffic information (data) (this can be a speed interval, for instance). Processing unit 52 compares a predetermined value interval 54 with the detected data to determine if it is contained 56 in the predetermined interval. If it is contained, it is included in the zone information 58 in the given interval. A zone is formed 58 for those route sections for which there is traffic information in the value interval. In addition, further parameters such as maximum zone sizes and/or road configurations or the like can be taken into account. For example, route sections in which speeds (=traffic information=data) lie between two predetermined values can be defined as a zone. The resulting zone can also be designated as an average-oriented zone 60 because this zone contains traffic information with a determined average value (lying approximately in the middle of the value interval). Further, it is possible to determine a zone-oriented average value for this zone (according to FIG. 3) as an alternative to or in addition to the definition of a zone.

What is claimed is:

1. A method for informing a user of a terminal device about a traffic situation in a traffic network comprising the steps of:

transmitting traffic information from a traffic center to the terminal device over a communications channel;

converting transmitted traffic information referring to at least one route section-oriented information in the traffic network into zone-oriented information relating to a zone in the traffic network, said step of converting being performed by a data processing unit;

displaying the zone-oriented information to the user of the terminal device, said step of converting being performed in the traffic center, and said traffic information being transmitted to a receiver in the terminal device as the zone-oriented information;

pre-categorizing route section-oriented information according to a type of road or roads to which it relates;

converting the route-section oriented traffic information to zone-oriented traffic information separately for each road type, the type of road or roads comprise at least one from a group consisting of highway, inter-regional major roads and inner city roads, and the route section-oriented traffic information comprises at least one selected from a group consisting of current speeds, possible speeds based on calculations in the traffic center used on respective route sections and measured values derived from the respective route sections;

forming an average value for the route section oriented traffic information data for a limited spatial zone route sections locating in this zone; and defining the formed average value as the traffic information for this zone.

2. The method set forth in claim 1, wherein said step of transmitting is performed over a communications channel, and said step of converting is performed in the terminal device.

3. The method set forth in claim 1, further comprising:

determining the route section oriented speeds relative to possible and permitted speed on the route section distinguished by these speeds; and determining information representing a relative hindrance to a vehicle in the route section when averaging the route sections.

4. The method set forth in claim 1, further comprising supplementing traffic information for route sections having no measurement data with assumptions based on typical values corresponding to the type of road.

5. The method set forth in claim 4, wherein said step of supplementing comprises forming assumptions based on selecting information from a group of information consisting of at least one of road type, structural features, and empirical values depending on the time of day.

6. The method set forth in claim 1, further comprising predetermining the spatial zone arbitrarily and on geographic factors, wherein said averaging is performed over this predetermined spatial zone.

7. The method set forth in claim 1, further comprising predetermining the spatial zone based on predefinable conditions and on geographic factors, wherein said averaging is performed over this predetermined spatial zone.

8. The method set forth in claim 1, further comprising:

determining spatial zones having substantially identical traffic data in the processing unit for conversion of route section-oriented traffic information to zone-oriented traffic information;

defining control parameters in the processing unit for enabling control of spatial resolution and control of a permissible deviation for said step of averaging, wherein said step of displaying provides the traffic information in the form of zones with substantially identical traffic conditions.

9. The method set forth in claim 8, wherein said step of displaying provides the traffic information in the form of contour surfaces having identical average values.

10. The method set forth in claim 8, wherein said step of displaying provides the traffic information in the form of isotachs.

11. The method set forth in claim 1, wherein the zone-oriented traffic information represents a measurement for the probability of a traffic backup in a zone.

12. The method set forth in claim 11, wherein the traffic information represents restrictions in the zone, the restrictions in the zone being at least one selected from a group consisting of an applicable speed limit in the zone, access and transit restrictions relating to the type of vehicle and vehicle cargo, restrictions relating to non-resident traffic, heavy trucks, hazardous materials traffic, and toll charges applicable in this zone for use of the traffic network.

13. A terminal device having a receiver for receiving route section-oriented traffic information transmitted over a communications channel comprising:

a data processing unit for converting the route section oriented traffic information into zone-oriented traffic information;

a user interface comprising at least one selected from a group consisting of an optical interface and acoustic interface for outputting the zone-oriented traffic information; and a graphic display for displaying zone-oriented traffic information in the form of contour surfaces having identical average values, said contour surfaces which can be displayed comprising at least one selected from a group consisting of an identical speed between areas, identical traffic backup possibilities and identical toll charges for a section of a road network.

14. The terminal device in accordance with claim 13, wherein the terminal is installed within a vehicle and further comprise a mobile radio receiver.

15. The terminal device in accordance with claim 14, further comprising:

a device for planning and enabling navigation along a route, said device being in communication with said radio receiver, said device being adapted to provide a digital road map to a user;

a converting unit for converting zone-oriented information into route section-oriented information based on the digital road map, said zone-oriented information and route section-oriented information being incorporated into said route planning and navigation by said device.

* * * * *